United States Patent [19]

Hussissian

[11] Patent Number: 4,502,357

[45] Date of Patent: Mar. 5, 1985

[54] SLOTTING HEAD

[76] Inventor: Vahan A. Hussissian, Barrington, Ill.

[21] Appl. No.: 511,527

[22] Filed: Jul. 7, 1983

[51] Int. Cl.[3] ..... B31B 1/22; B26D 1/24; B26D 7/26

[52] U.S. Cl. ..... 83/332; 83/676; 83/699; 493/368; 493/475

[58] Field of Search ..... 83/332, 676, 699; 493/368, 475

[56] References Cited

U.S. PATENT DOCUMENTS

| | | | |
|---|---|---|---|
| 2,701,613 | 2/1955 | Bishop | 83/332 |
| 3,067,643 | 12/1962 | Ward | 83/332 |
| 3,466,982 | 9/1969 | Sullivan | 83/332 X |
| 3,985,066 | 10/1976 | Kern | 83/332 X |
| 4,003,300 | 1/1977 | Grobman | 493/368 |

*Primary Examiner*—Donald R. Schran

[57] ABSTRACT

A slotter head having slotter knives which are carried by the slotter head and are adjusted circumferentially with respect to one another simply by manually operating a handle which functions to release a locking mechanism. With the locking mechanism released, one of the slotter knives can be adjusted circumferentially with respect to the other knife simply by manually rotating an annular plate to which it is removably affixed. Thereafter, the handle is again manipulated to cause the locking mechanism to lock the rotatably adjustable annular plate carrying the slotter knife to position the slotter knife in a fixed position with respect to the other slotter knife.

9 Claims, 6 Drawing Figures

SLOTTING HEAD

BACKGROUND OF THE INVENTION

This invention relates to an improved slotting head for use with paperboard printer slotters. More particularly, it relates to an improved slotter head constructed such that the slotter knives carried by the slotter head can be easily and quickly, manually, adjustably positioned to change the cuts made in the paperboard by the slotter head.

Slotter heads on printer slotters are well-known in the art. Generally, the slotter heads are provided with at least two slotter knives which project beyond the periphery of the slotter head and each knife is adapted to cooperate with an annular groove in an opposing female slotter head. The slotting heads are mounted on rotatable parallel shafts. The slotter knives have been customarily attached to their respective heads by clamping bolts. The clamping bolts are adapted to be loosened manually so that the knives may be circumferentially adjusted on their head in order that they may be used to slot different sizes of box blanks.

In order to adjust a slotter knife, it is necessary to move sections of the printer slotter away from each other to facilitate access to the slotter heads. Thereafter, bolts are loosened and one knife is adjusted circumferentially with respect to the other knife. Each knife must be adjusted in this fashion. Obviously, this is a time consuming task. If different sizes of paperboard box blanks are to be processed during a given period, considerable time is lost in making the necessary adjustments to the slotter knives.

Various arrangements have been proposed to set the slotter knives, including many arrangements where the slotter knives are set simultaneously on all of the slotter heads. These arrangements generally are complex, and not entirely satisfactory, for one reason or another.

In accordance with the present invention, these slotter knives carried by the slotter head are adjusted circumferentially with respect to one another simply by manually operating a handle which functions to release a locking mechanism. Once the locking mechanism is released, one of the slotter knives can be adjusted circumferentially with respect to the other kinfe simply by manually rotating it. Thereafter, the handle is once again manipulated to cause the locking mechanism to lock the adjustable slotter knife in a fixed position with respect to the other slotter knife.

Accordingly, it is an object of the present invention to provide an improved slotter head constructed such that the slotter knives carried by the slotter head can be easily and quickly, manually adjustably positioned to change the cuts made in the paperboard by the slotter head.

DESCRIPTION OF THE DRAWINGS

The above objection as well as others not specifically mentioned will be apparent from the following description taken in conjunction with the following drawings wherein.

DESCRIPTION OF THE INVENTION

Figure 1:
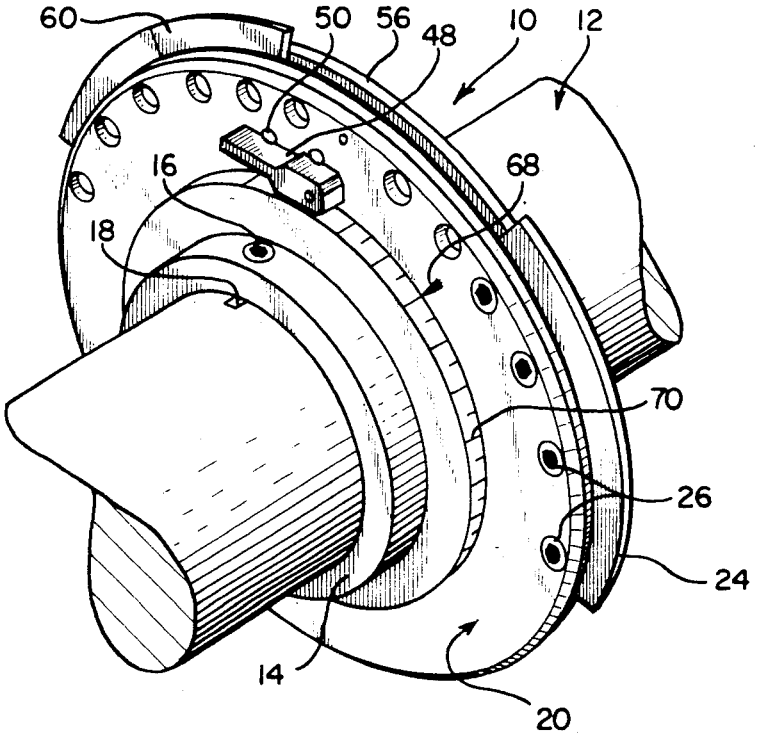
FIG. 1 is a perspective view of a slotter head exemplary of the present invention.

Referring now to the drawings, in FIG. 1 there is illustrated a slotter head 10 which is fixedly secured to a shaft 12. The slotter head 10 is provided with two slotter knives 24 and 60 which project beyond the periphery of the slotter head. As indicated above, each of these slotter knives is adapted to cooperate with an annular groove in an opposing female slotter head. The slotter head 10 as well as the female slotter head are mounted on rotatable parallel shafts. The shaft 12 represents one of these rotatable parallel shafts.

Figure 5:
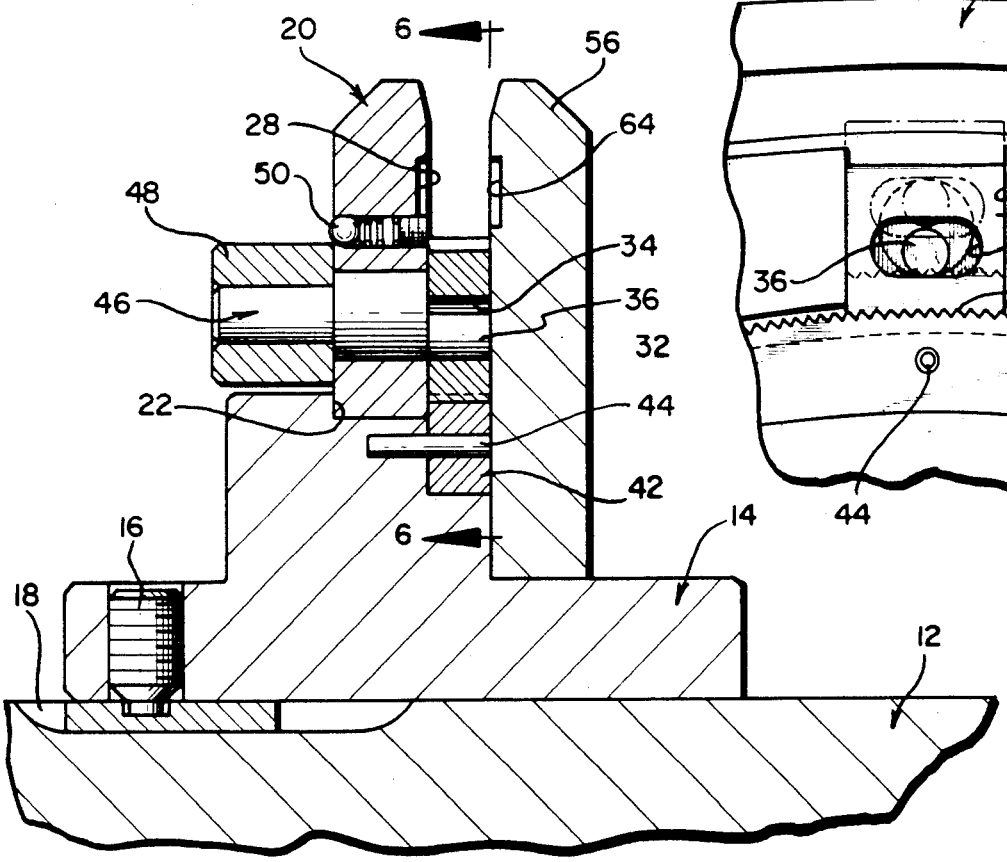
FIG. 5 is a sectional view taken along lines 5—5 of FIG. 2.
Figure 6:
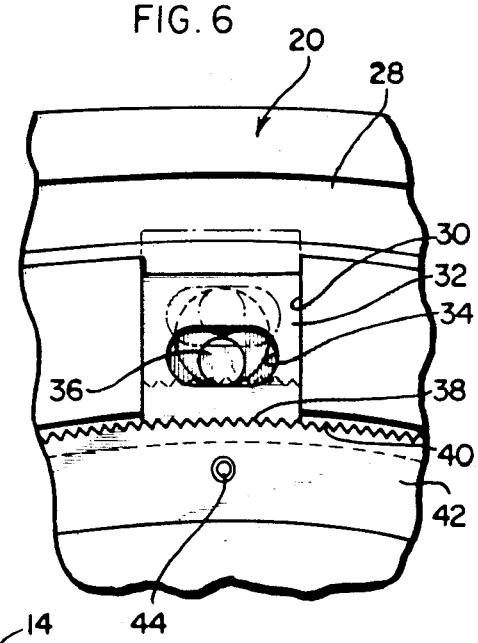
FIG. 6 is a sectional view taken along lines 6—6 of FIG. 5.
Figure 3:
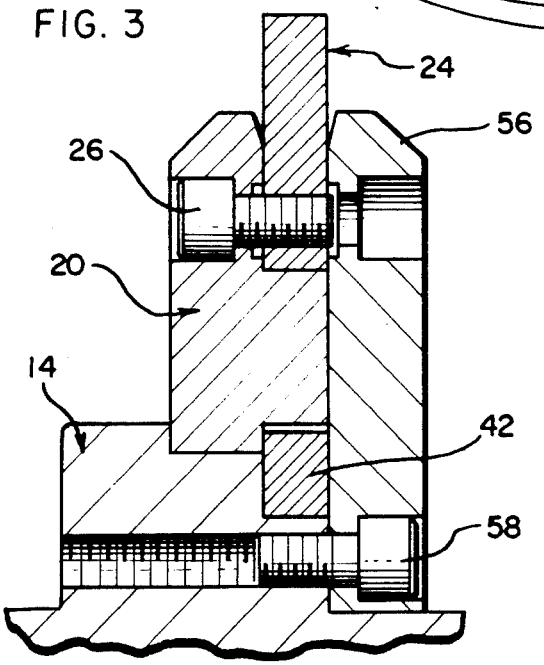
FIG. 3 is a sectional view taken along lines 3—3 of FIG. 2.
Figure 4:
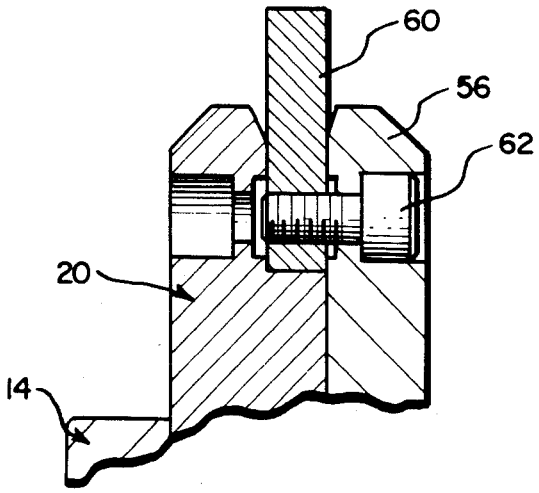
FIG. 4 is a sectional view taken along lines 4—4 of FIG. 2.

The slotter head 10 has a hub 14 through which the shaft 12 extends, and the hub 14 is affixed to the shaft 12 by means of a set-screw 16 which engages a key 17 disposed within a keyway slot or groove 18 formed in the shaft 12, as can be best seen in FIG. 5. An annular plate 20 is carried by the hub 14 and, as can be best seen in FIG. 5, abuts against a shoulder 22 of the hub 14. The slotter knife 24, as can be best seen in FIG. 3, is removably secured to the annular plate 20 by means of a number of threaded screws 26. The annular plate 20 has an annular groove 28 (FIG. 5) which provides clearance for threaded screws 62 (FIG. 4) which are used to secure the slotter knife 60 to an annular plate 56 which is more fully described below. The annular plate 20, as can be best seen in FIG. 6, has a rectangular slot 30 formed in it in which is slidably retained a locking plate 32. The locking plate 32 has an oblong groove 34 formed in it, and a pin 36 is retained within this oblong groove 34 for adjustably positioning the locking plate 32, as more fully described below. The locking plate 32 has teeth 38 formed on the lower end of it, which teeth 38 lockingly engage with correspondingly formed teeth 40 formed on the periphery of an annular ring 42 secured to the hub 14 by means of a number of pins 44.

The pin 36 is part of a crank arm 46 which extends through and is retained within the annular plate 20. The pin 36 is affixed to the crank arm in an eccentric fashion, as can be best seen in FIG. 5, and the crank arm 46 including the pin 36 is manually operated by a handle 48 affixed to the crank arm 46. As can be best seen in FIG. 6, when the handle 48 is manually adjusted i.e., by rotating the handle 48 approximately 90°, the pin 36 within the groove 34 slidably raises and lowers the locking plate 32 within the rectangular slot 30 to engage and disengage the teeth 38 and 40. The handle 48 is retained within a locked position or an opened position by means of poppit locks 50 (FIG. 5).

The annular plate 56 is fixedly secured to the hub 14 by means of a number of threaded screws 58 (FIG. 3). The slotter knife 60, as indicated above, is removably secured to the annular plate 56 by means of a number of threaded screws 62, as can be beat seen in FIG. 4. The annular plate 56 has an annular groove 64 formed in it for providing clearance for the threaded screws 26 which are used to secure the slotter kinfe 24 to the annular plate 20.

Figure 2:
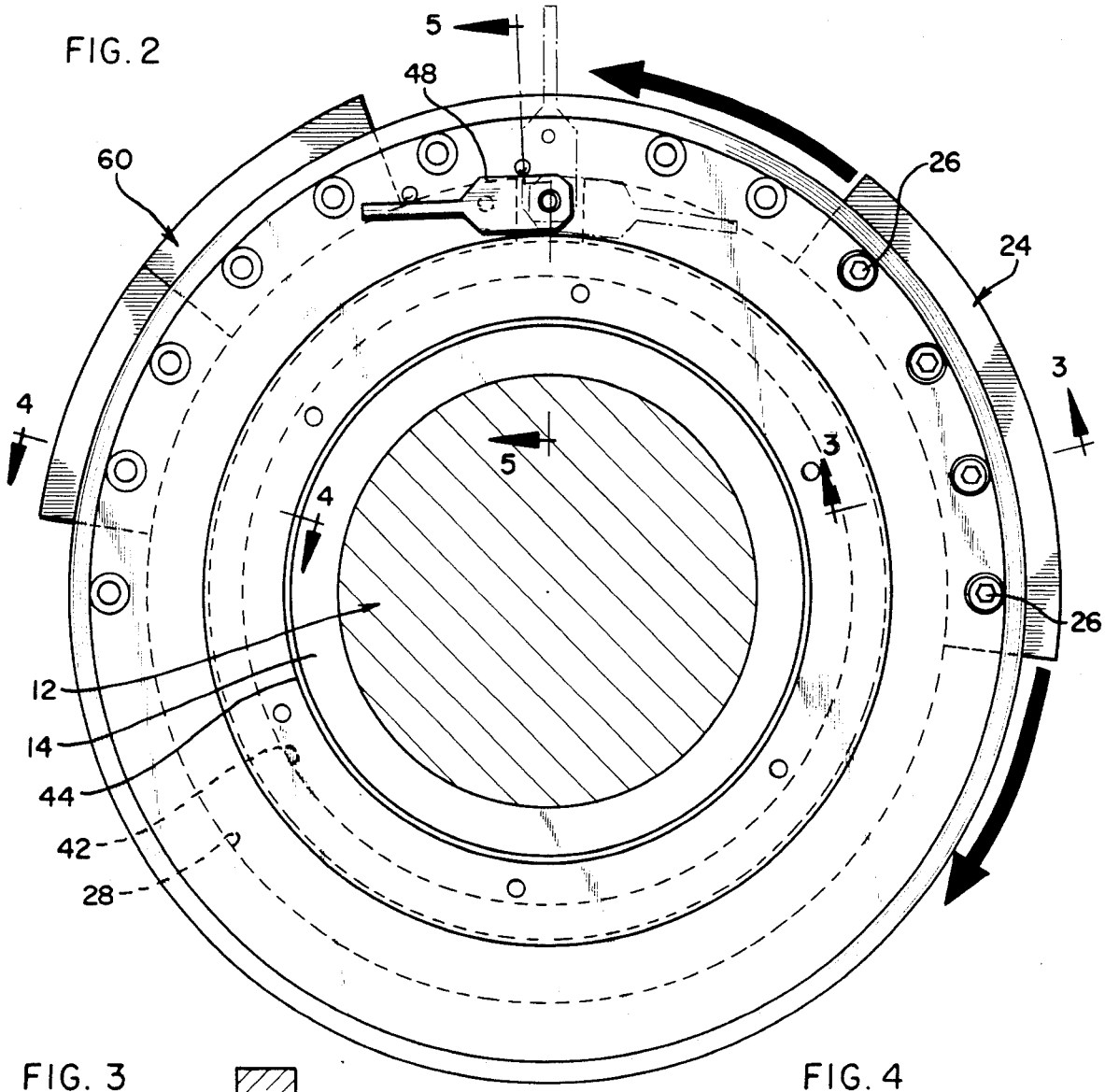
FIG. 2 is a side plan view, partially sectionalized, of the slotter head of FIG. 1.

In the illustrated embodiment, the slotter knife 24 is easily and quickly adjusted circumferentially with respect to the slotter knife 60 simply by manually manipulating the handle 40 from the substantially horizontal position, as shown in FIG. 2, to the dotted line position. In manipulating the handle 48 in this fashion, the locking plate 32 is slidably raised within the rectangular slot 30 by means of the pin 36 to disengage its teeth 38 from the teeth 40 on the annular ring 42 secured to the annular plate 20. With the teeth on the locking plate 38 disengaged, the annular plate 20 together with the slotter knife 24 which is secured to it can be rotated on the hub 14 to circumferentially adjust the position of the slotter knife 24 with respect to the slotter knife 60. An indicia arrow 68 is provided on the side of the annular plate 20 and indicia graduations 70 are provided on the hub 14 (FIG. 1) as a guide in properly positioning the slotter knife 24 with respect to the slotter knife 60. When the slotter knife 24 is circumferentially positioned as desired, the handle 48 once again is manually manipulated to slidably lower the locking plate 32 in the rectangular slot 30 formed in the annular plate 20 to lockingly engage the teeth 38 and 40 to fixedly lock the annular plate 20 against further rotation. With the teeth 38 and 40 lockingly engaged, the annular plate 20 and the annular plate 56 rotate together with the hub 14 which is secured to and rotates with the shaft 12.

Accordingly from the above description, it can be seen that the slotter knife 24 of the slotter head 10 can be easily and quickly adjusted circumferentially with respect to the slotter knife 60, simply by operating the handle 48 to release the locking plate 32 so that the annular plate 20 can be rotated with respect to the annular plate 56.

What is claimed is:

1. A slotter head for use with paperboard printer slotters comprising:

a hub adapted to be affixed to a shaft;

a first annular plate carried by said hub and rotatable with respect to said hub;

a locking plate carried by said first annular plate and having thereon a first set of locking teeth;

a second set of locking teeth carried by said hub and engagable by said first set of locking teeth on said locking plate;

means carried by said first annular plate for operating said locking plate to lockingly engage and to disengage said first and second sets of locking teeth;

a second annular plate carried by said hub and removably affixed thereto;

a slotter knife removably affixed to the respective ones of said first and second annular plates;

said slotter knife removably affixed to said first annular plate being adjustable circumferentially with respect to said slotter knife removably affixed to said second annular plate by operating said locking means to disengage said first set of locking teeth with said second set of locking teeth and rotating said first annular plate with respect to said second annular plate.

2. The slotter head of claim 1, wherein said slotter knife on said first annular plate is fixed circumferentially with respect to said slotter knife on said second annular plate by operating said locking plate to engage said first and second sets of locking teeth.

3. The slotter head of claim 2, wherein said first annular plate has a slot formed in it for slidably receiving therein said locking plate.

4. The slotter head of claim 2, further comprising an annular ring affixed to said hub, said second set of locking teeth being formed on said annular ring and engagable by said first set of locking teeth.

5. The slotter head of claim 3, wherein said means for operating said locking plate comprises a crank arm carried by said first annular plate, said crank arm having a handle affixed to one end thereof for manually operating said crank arm and a pin eccentrically affixed to the other end thereof, said locking plate having a slot formed in it for receiving therein said pin, said pin upon operation of said crank arm by means of said handle operating to slidably raise and lower said locking plate in said slot in said first annular plate to disengage and engage said first and second sets of locking teeth.

6. The slotter head of claim 5, further comprising means for releasibly locking said handle on said crank arm in an established position against rotation.

7. The slotter head of claim 1, comprising indicia on said hub and said first annular plate for indicating the position of said first annular plate on said hub.

8. The slotter head of claim 1, wherein said second annular plate is removably affixed to said hub by means of a plurality of threaded screws.

9. The slotter head of claim 1, wherein said slotter knives are removably affixed to said first and second annular plates by means of a plurality of threaded screws.

* * * * *